US006825742B1

(12) United States Patent
Luque

(10) Patent No.: US 6,825,742 B1
(45) Date of Patent: Nov. 30, 2004

(54) APPARATUS AND METHODS FOR SPLIT-FEED COUPLED-RING RESONATOR-PAIR ELLIPTIC-FUNCTION FILTERS

(75) Inventor: Norman A. Luque, Londonderry, NH (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 10/331,812

(22) Filed: Dec. 30, 2002

(51) Int. Cl.[7] ..... H01P 1/20
(52) U.S. Cl. ..... 333/204; 333/219
(58) Field of Search ..... 333/202, 204, 333/205, 219, 246

(56) References Cited

U.S. PATENT DOCUMENTS

| | | | | |
|---|---|---|---|---|
| 3,963,998 A | | 6/1976 | Richter | 333/211 |
| 4,264,881 A | * | 4/1981 | De Ronde | 333/110 |
| 5,442,330 A | * | 8/1995 | Fuller et al. | 333/204 |
| 5,497,131 A | | 3/1996 | Takahashi et al. | 333/204 |
| 5,587,690 A | | 12/1996 | Yabuki et al. | 331/2 |
| 5,614,876 A | | 3/1997 | Takahashi et al. | 333/204 |
| 5,659,274 A | | 8/1997 | Takahashi et al. | 333/204 |
| 5,786,303 A | | 7/1998 | Mansour | 505/210 |
| 5,990,765 A | * | 11/1999 | Mansour et al. | 333/204 |
| 6,108,569 A | * | 8/2000 | Shen | 505/210 |
| 6,373,354 B2 | | 4/2002 | Schallner et al. | 333/235 |
| 6,563,403 B2 | | 5/2003 | Kanba et al. | 333/204 |
| 6,686,815 B1 | | 2/2004 | Mirshekarl-Syahkal et al. | 333/202 |

OTHER PUBLICATIONS

Coppinger, et al., "Photonic Microwave Filtering Using Coherently Coupled Integrated Ring Resonators", Microwave and Optical Technology Letters, Vol. 21, No. 2, pp. 90–93, Apr. 20, 1999.

Otto Schwelb, "Some Novel Photonic Bandpass and Bandstop Filters", http://www.ece.concordia.ca/=otto/Ismot11.htm. Visited Oct. 4, 2002.

Grover, et al., Parallel–Cascaded Semiconductor Microring Resonators for High–Order and Wide–FSR Filters, Journal of Lightwave Technology, pp. 1–6.

Hong et al., "Realisation of Quasielliptic Function Filter Using Dual–Mode Microstrip Square Loop Resonators", Electronics Letters, 31:24, pp. 2085–2086, Nov. 23, 1995.

* cited by examiner

*Primary Examiner*—Robert Pascal
*Assistant Examiner*—Dean Takaoka
(74) *Attorney, Agent, or Firm*—David E. Huang, Esq.; Jeffrey J. Duquette, Esq.

(57) ABSTRACT

A filter has coupled pairs of resonators positioned between and planar to split feed lines. The filters are further positioned orthogonal to the signal path. The filter has two pairs of resonators. Coupling extensions of the split feed lines are substantially parallel to each other. The resonators couple with the split feed lines at the coupling extensions. The resonators in each pair also couple to each other. The topology effectively forms an Elliptic Function response bandpass filter with high close-in frequency rejection capability. The filter can be cascaded to provide improved frequency rejection. Further, this topology may be relatively inexpensively produced using standard lithography techniques.

36 Claims, 13 Drawing Sheets

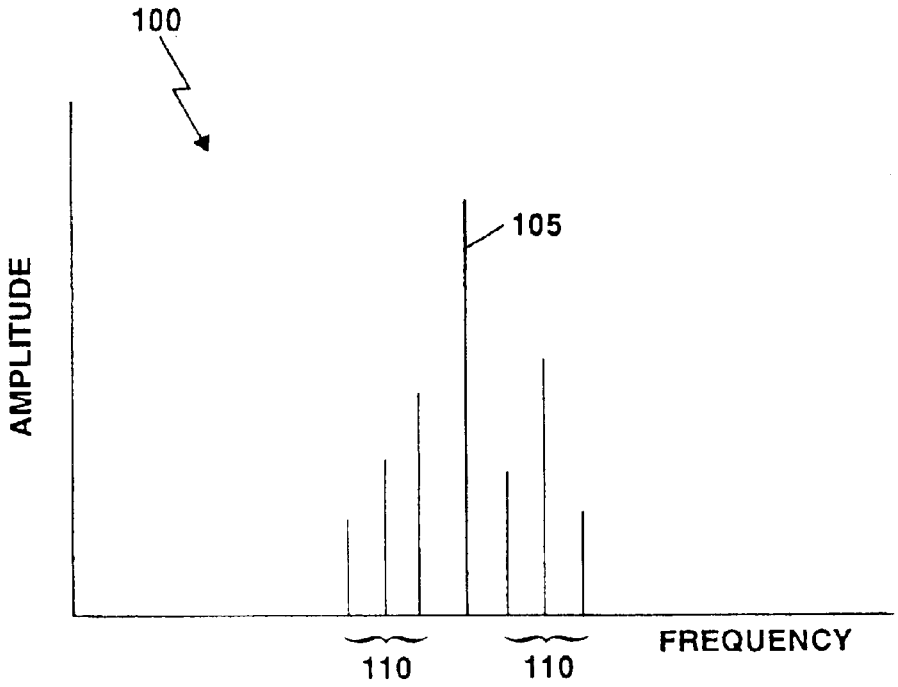
*Figure 1* *(PRIOR ART)*
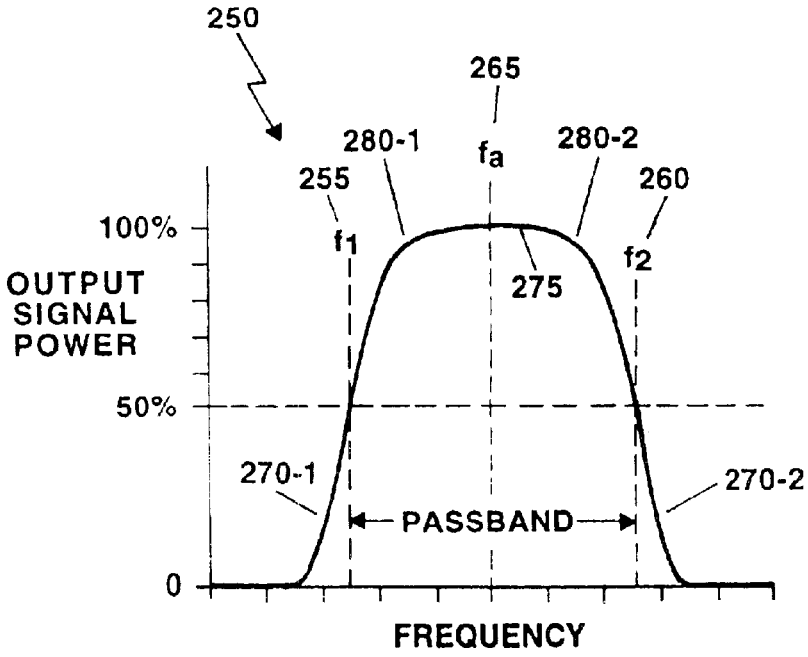
*Figure 4* *(PRIOR ART)*

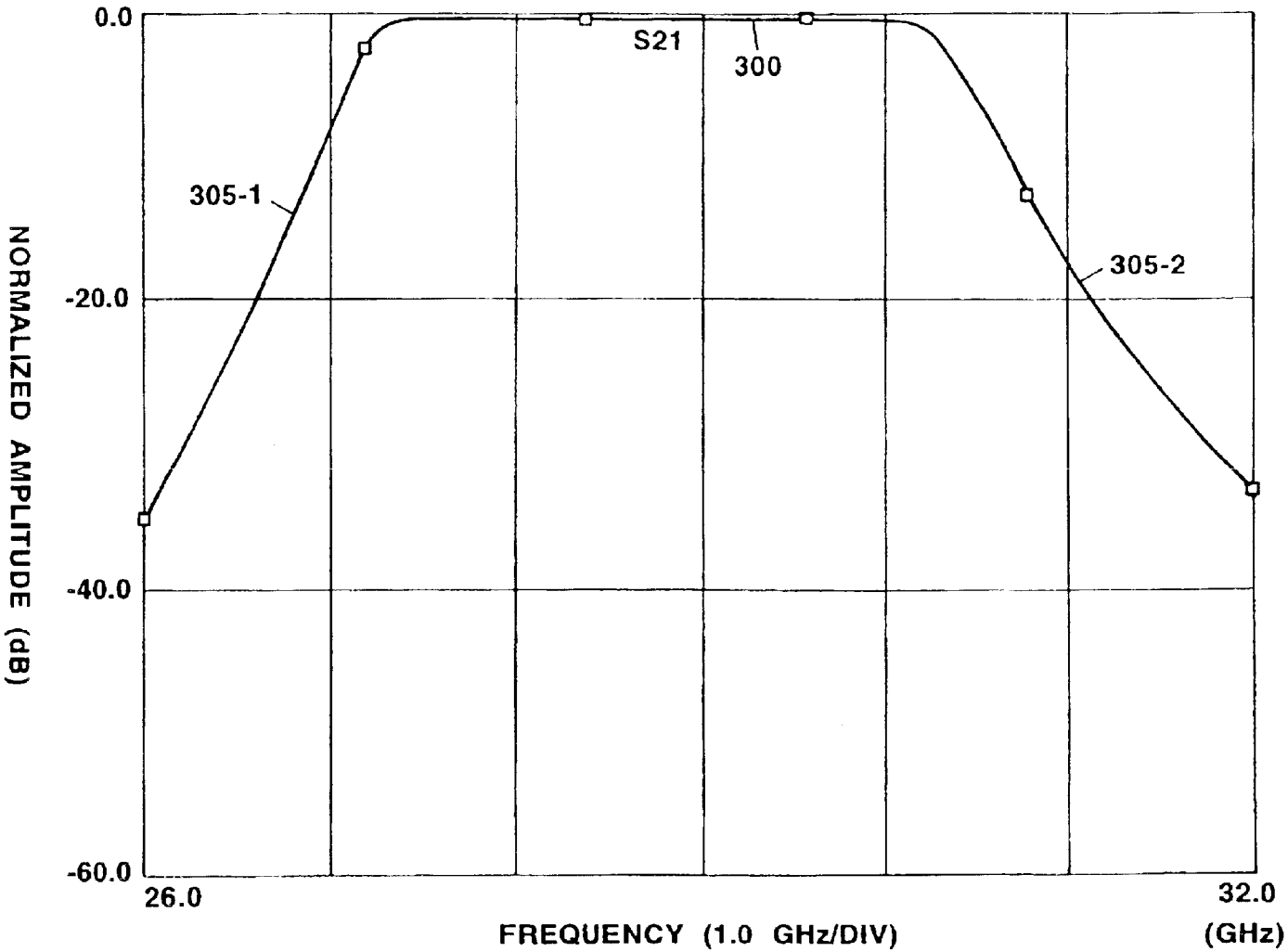
*Figure 6* *(PRIOR ART)*

APPARATUS AND METHODS FOR SPLIT-FEED COUPLED-RING RESONATOR-PAIR ELLIPTIC-FUNCTION FILTERS

BACKGROUND OF THE INVENTION

In general, a filter within an electrical circuit allows selected signals to "pass" while blocking other signals. One type of filter is a bandpass filter. A typical bandpass filter is an electrical device or circuit that allows signals in a specific frequency range to pass, but that blocks signals at other frequencies.

Bandpass filters are frequently used in electrical circuits in devices such as radio, television, cordless and cellular telephones, wireless communications systems, radar, sensors, and some types of manufacturing measurement and instrumentation systems. These devices transmit and receive signals using electromagnetic waves.

A primary function of a bandpass filter in a transmitter is to limit the bandwidth of the output spectrum. In a receiver, a bandpass filter allows the receiver to receive a selected range of frequencies, while rejecting signals at unwanted frequencies. A bandpass filter also optimizes the signal-to-noise (sensitivity) of a receiver. In both transmitting and receiving applications, well-designed bandpass filters, having the optimum bandwidth for the mode and speed of communication being used, maximize the number of signals that can be transferred in a system, while minimizing the interference or competition among signals.

An example of an application of filters in electronics is in microwave communications, that is, wireless communications using signals in the microwave portion of the electromagnetic spectrum. Conventional filter designs intended to operate at high frequencies include edge-coupled, surface acoustic wave (SAW), dielectric resonator and waveguide filters. Another type of conventional filter used in microwave communications is a filter having two square loop resonators where the square loop resonators are positioned on either side of a core material where the loops are off-center from each other. This type of filter can be realized in two layers of a printed wiring board, for example. In operation, the square loop resonators cross-couple with each other thereby each influencing the electrical response of the other to produce a signal useful in microwave communications. The response of this filter is controlled by varying the amount of offset in the relative positions of the resonators.

SUMMARY OF THE INVENTION

Conventional filter design and operation suffers from a variety of difficulties. For example, conventional signal filtering technology typically does not filter well where unwanted frequencies are close to a selected pass frequency. This often causes difficulty in blocking the unwanted signal. Filters in these situations are typically used to band-limit thermal noise and to reject image frequencies and other close-in spurious signals. The requirements for high frequency bandpass filters typically include a compact topology, a narrow, sharp passband, high rejection at close-in frequencies and overall inexpensive fabrication and tuning. In the above-described conventional edge-coupled, surface acoustic wave (SAW), dielectric resonator and waveguide filters, the resonator topologies have relatively high fabrication costs and are bulky and difficult to tune. It remains desirable to have a method and apparatus for a bandpass filter having high selectivity for passing a desired frequency while filtering close-in undesirable frequencies.

Embodiments of the present invention significantly overcome such deficiencies by providing techniques for filtering which use a novel filtering structure having a coupled ring resonator topology. Such a structure is well-suited for bandpass filtering because it provides a high close-in rejection elliptic-response. Such a structure yields filters that are small and narrow-band. Further, this topology is advantageous in that it can be realized using relatively inexpensive standard lithography techniques.

More specifically, embodiments of the invention provide methods and apparatus that use ring resonator pairs placed orthogonally to feed lines in a filter circuit. The feed lines are split in order to couple with two resonator pairs. The resonators in each resonator pair couple with each other as well as with the feed lines. Resonator placement in relation to other resonators and resonator coupling length are used to tune the filter circuit in order to pass selected frequencies. Resonator placement in relation to feed lines and width of the resonator are also used to tune the filter circuit. In one embodiment, this topology effectively forms an Elliptic Function response bandpass filter with high close-in rejection capability. Further, these topologies of embodiments of the invention may be relatively inexpensively produced standard lithography techniques such as those used in printed wiring board manufacturing or in thin film manufacturing.

One such embodiment of a filter includes a first feed line having a first stem connected to a first coupling extension and a second coupling extension and a second feed line having second stem connected to a third coupling extension and a fourth coupling extension where the first coupling extension is substantially parallel to the third coupling extension and the second coupling extension is substantially parallel to the fourth coupling extension. The embodiment further includes four ring resonators located planar to the first and the second feed lines, two of the ring resonators being positioned between the first and the third coupling extensions and two other of the ring resonators being positioned between the second and the fourth coupling extensions such that the four ring resonators are coupled to the feed lines to form a first resonant circuit. The resonant circuit of this topology provides a well-defined passband where close-in frequencies can be blocked while passing a signal of a selected frequency.

In another embodiment of the invention, each ring resonator is substantially one-quarter wavelength ($\lambda/4$) on each side providing a passband that is substantially centered on the selected frequency. Accordingly, the filter can be centered about a particular frequency by scaling the resonator lengths proportionally to wavelength.

In another embodiment of the invention, each ring resonator is a square-shaped ring. Square-shaped rings couple more effectively with the feed-lines and with each other than rounded ring resonators. In another embodiment of the invention, each side of the square-shaped rings is substantially one quarter wavelength ($\lambda/4$) of the selected center frequency. Further, the portion of each the coupling extension that is adjacent to a side of each square-shaped resonator forms a coupling point, and each coupling point is a quarter wave coupler. This provides balanced resonance throughout the resonant circuit.

In another embodiment of the invention, the feed-lines, coupling extensions and ring resonators are conductive features of a signal layer on a substrate. In these embodiments of the invention, the bandpass filter formed using the disclosed inventive features is part of a circuit.

In another embodiment of the invention, the bandpass filter further includes a fifth ring resonator between the first and the third coupling extensions and a sixth ring resonator between the second and the fourth coupling extensions. Additional resonators in the bandpass filter improve the definition of the passband.

In another embodiment of the invention, the ring resonators are positioned relative to each other such that each the ring resonator affects resonance in adjacent resonators such that the passband of the bandpass filter is defined. The positioning the ring resonators relative to each other effectively tunes the bandpass filter.

In another embodiment of the invention, bandpass filter is configured to operate in the radio frequency region of the electromagnetic spectrum. In this way, the features of the bandpass filter are re-sized according to a selected frequency from the radio frequency range.

In another embodiment of the invention, a first resonant circuit having ring resonators and a second resonant circuit having ring resonators as described above are connected in series. This is also referred to as "cascading" the filters. The filters connected in series provide an even sharper passband than one filter alone.

Method embodiments of the invention include a method of filtering, including the steps of providing a first feed line and a second feed line, providing a pair of ring resonators positioned orthogonal to the feed lines, and providing coupling extensions on each feed line such that the feed lines couple to the a pair of ring resonators to form a first resonant circuit.

In another embodiment of the invention, the method further includes placing the at least two ring resonators in relation to each other such that each the ring resonator affects resonance in adjacent resonators such that a passband of the bandpass filter is defined whereby the bandpass filter is tuned.

In another embodiment of the invention, the method further includes the step of configuring the first and the second feed-lines, the at least two pairs ring resonators and the coupling extensions to operate at radio frequencies.

In another embodiment of the invention, the method further includes forming the first and second feed lines, the at least two ring resonators and the coupling extensions as features on a plane of a substrate using printed wiring board technology. In another embodiment of the invention, the method further includes forming the first and second feed lines, ring resonators and the coupling extensions as features on a plane of a substrate using thin film techniques. In this way, the bandpass filters can be constructed using relatively inexpensive, standard manufacturing techniques thus making them relatively inexpensive and easy to implement.

BRIEF DESCRIPTION OF THE DRAWINGS

The foregoing and other objects, features and advantages of the invention will be apparent from the following description of particular embodiments of the invention, as illustrated in the accompanying drawings in which like reference characters refer to the same parts throughout the different views.

FIG. 1 is a graph of amplitude vs. frequency in a prior art filter circuit;

FIG. 4 is an output signal power vs. frequency graph of passband response for a hypothetical prior art bandpass filter;

FIG. 6 is a graph showing an example of a simulated passband response of the prior art resonator of FIG. 2;

DETAILED DESCRIPTION

Figure 2:
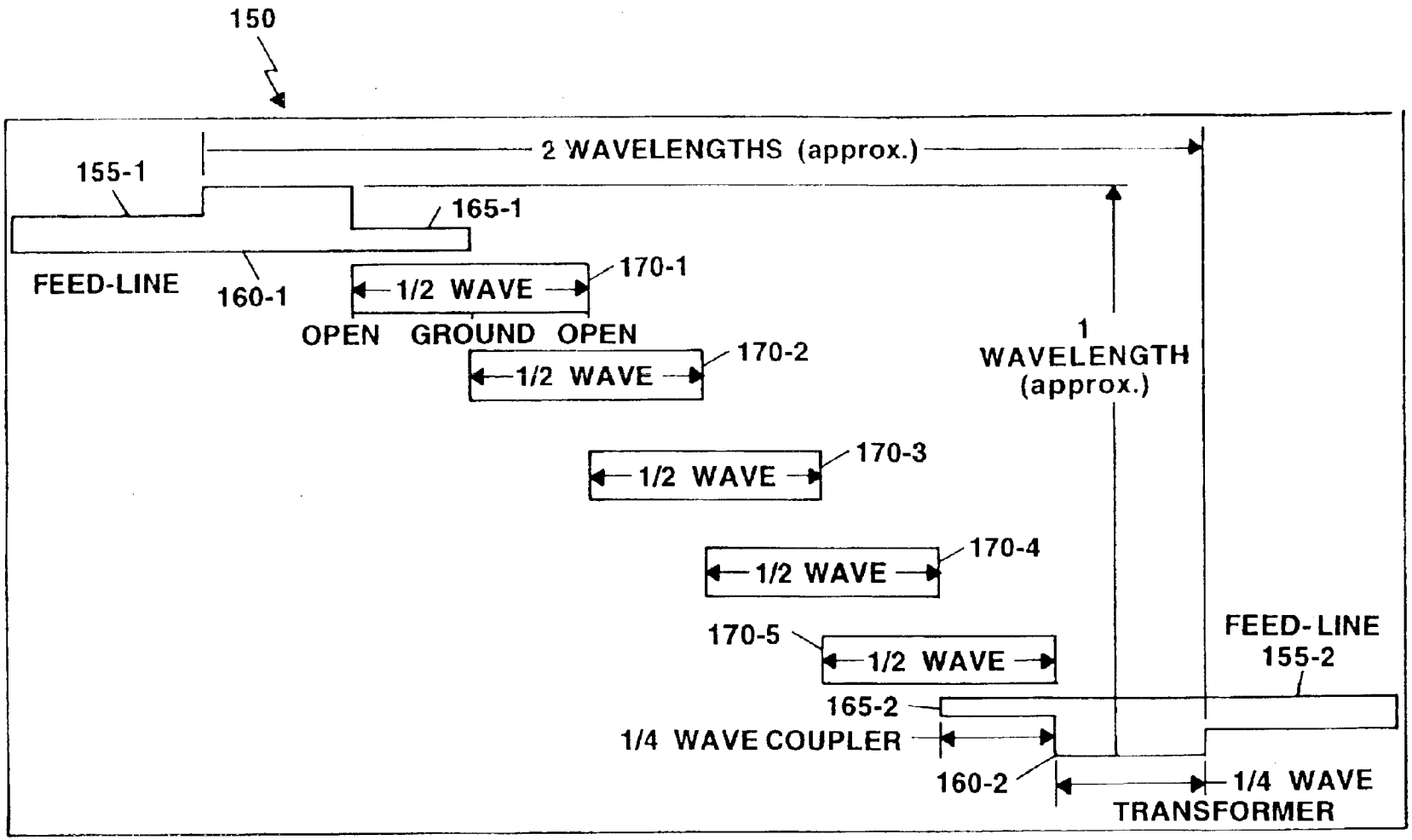
Figure 2 (PRIOR ART)
FIG. 2 is a top view of the elements on a substrate of a prior art 5-resonator edge-coupled bandpass filter.

Wireless communications require filter topology that yields filters that are small, narrow-band and provide high close-in signal rejection. Embodiments of the present invention provide mechanisms and techniques for a coupled ring resonator topology providing such filters. Further, the embodiments of the invention can be advantageously realized using relatively inexpensive standard lithography techniques such as the techniques used in printed wiring board manufacture or semiconductor manufacturing. Embodiments of the present invention include two pairs of ring resonators. In one arrangement, the ring resonators are arranged side-by-side with respect to each other and orthogonally with respect to the input and output lines. In one arrangement, the resonators are square-ring resonators. The sides of each ring resonator are tuned to substantially ($\lambda/4$) of the frequency of circuit operation. The input and output lines are split in order to couple to all ring resonators present in the arrangement. Each ring resonator is placed in relation to the split feed in such a way that the ring and feed substantially form a ($\lambda/4$) coupler. The Elliptic Function response achieved by one embodiment of the filter topology in the present invention allows for less than 10% bandwidth and higher rejection than an equivalent Chebyshev filter.

FIGS. 1–6 are presented to allow the reader to gain an understanding of filters and filter signal response, particularly, for filters used in high-frequency applications. In wireless communications for example, a wireless signal and a carrier wave are input to a signal mixer and their frequencies are changed. In making this conversion, spurious signals are unintentionally produced by the circuitry or the environment or a combination of both. Many times, the spurious signals are very close to the desired signal. FIG. 1 is a graph 100 of frequency versus signal in a conventional filter circuit where the graph shows a desired signal and spurious signals. In the graph, the horizontal axis is frequency measured in Hertz and the vertical axis is amplitude. The selected pass frequency 105 is the signal having the largest amplitude signal. On either side of the desired frequency are spurious signals 110 close to the desired signal 105. Conventional filters do not provide a bandpass filter that passes only a narrow band such that the desired signal is passed but the spurious signals, particularly the close spurious signals, are blocked. Embodiments of the present invention, however, enable one band of signal to be passed while other frequencies, even those close to the passed frequency, are blocked.

In particular, modern microwave systems require high-performance narrow-band bandpass filters having low insertion loss and high selectivity together with linear phase or flat group delay in the passband. These criteria are generally fulfilled by conventional filters having an Elliptic Function response. Generally the realization of Elliptic Function response filter characteristics requires cross-couplings between nonadjacent resonators.

FIG. 2 is a top view of the elements on a substrate of a conventional 5-resonator edge-coupled bandpass filter that provides a Chebyshev filter response. In one arrangement of these elements, the elements are printed elements on a signal layer of a printed wiring board. In another arrangement of these elements, the elements are created using thin film techniques on a substrate.

The conventional bandpass filter of FIG. 2 is constructed from a plurality of half-wave resonators which are cascaded in an overlapping, edge-coupled fashion. This conventional bandpass filter 150 has a first feed line 155-1 and a second feed line 155-2. Each feed line 155 has a ¼-wave transformer 160 connected to a ¼-wave coupler 165. Between the first feed line 155-1 and the second feed line 155-2 is a five-node resonator having five cascaded half-wave resonators, or waveguides 170-1, 170-2, 170-3, 170-4, 170-5 (collectively 170). Each half-wave resonator 170 is ½-wave of a selected center frequency in length. Each half-wave resonator 170 has a ground point at a point substantially in the center of the strip. Each half-wave resonator 170 further has an open at either end of the half-wave resonator 170. In FIG. 2, the ground and opens are indicated on half-wave resonator 170-1.

In the conventional filter of FIG. 2, the half-wave resonator 170 are edge-coupled to each other as well as to the feed line ¼-wave couplers 165. That is, the ¼-wave coupler 165-1 of the first feed line 155-1 is edge-coupled to its adjacent half-wave resonator 170-1 and the second ¼-wave coupler 165-2 is edge-coupled to its adjacent half-wave resonator 170-5. The middle three resonators 170-2, 170-3, 170-4 are edge-coupled to the resonators 170-1, 170-5 on either side of them. The middle point of each half-wave resonator, that is, the ground, is the reference point. There is ¼ wave of vibration from the reference point to the edge of the half-wave resonator. The resonators 170 resonate only at a particular band of frequencies. Where each resonator 170 is a little offset, a wider band of pass frequencies is produced. The resonators 170 interact with each other. If the gap between resonators 170 is large, the interaction between resonators decreases. If the gap between resonators 170 is small, each resonator pulls on the adjacent resonator(s).

A conventional solution to increasing filter sharpness was to cascade several resonators as in the bandpass filter shown in FIG. 2. In practice, if many conventional resonators are assembled together in the circuit, a desirable output is not necessarily obtained. As the filter sharpness is increased by the additional resonators, insertion and return losses are degraded, as well as the filter's manufacturability.

Figure 3A:
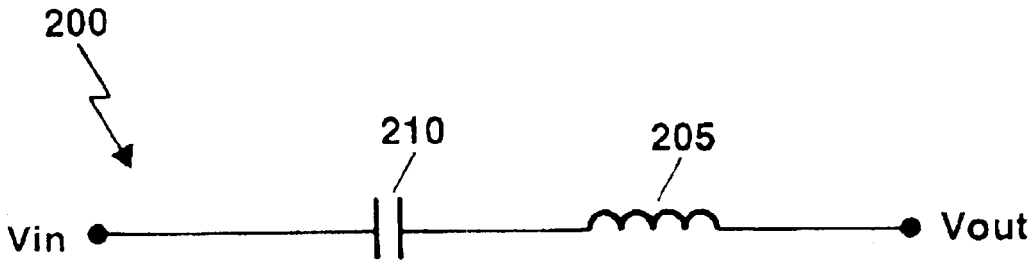
Figure 3A (PRIOR ART)
FIG. 3A is a diagram of a simple prior art resonator.

FIG. 3A shows a basic series resonator representation 200 for a resonator 170 of FIG. 2. The resonator representation 200 for the half-wave resonator 170 includes an inductive component 205 and a capacitance component 210.

Figure 3B:
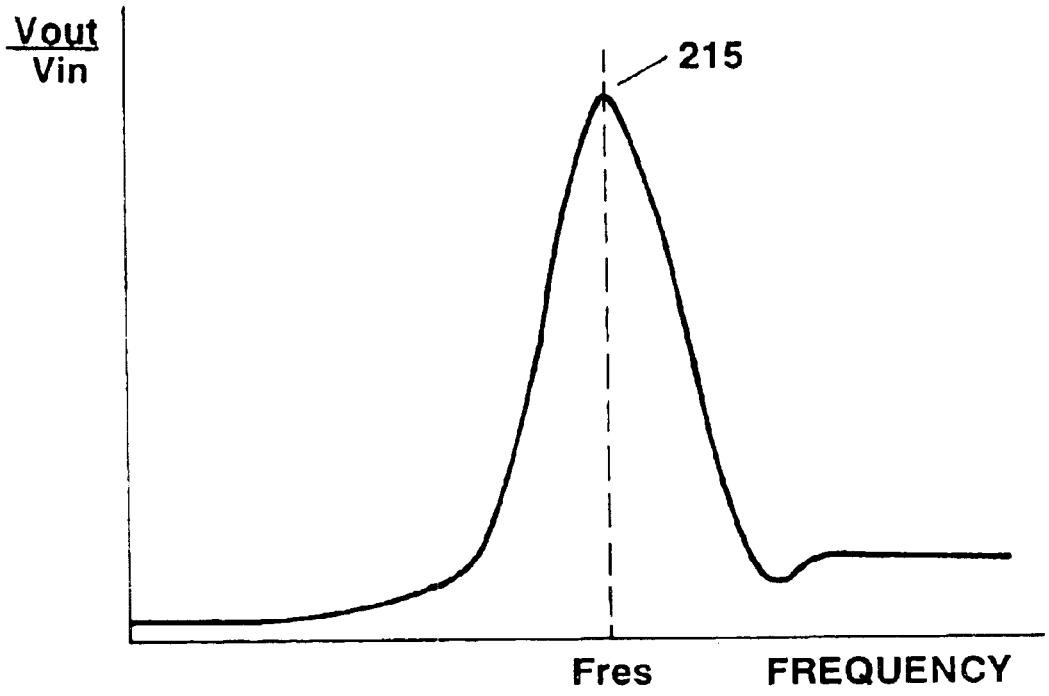
Figure 3B (PRIOR ART)
FIG. 3B is a graph of the electrical performance of the prior art resonator of FIG. 3A.

FIG. 3B shows the amplitude-vs-frequency graph of the passband response of the half-wave resonator 170 for a conventional filter. When capacitors are combined with inductors, it is possible to make circuits that have very sharp frequency characteristics. A circuit having capacitance and inductance has a resonant frequency that is inversely proportional to the square root of the product of the capacitance and inductance as shown in Equation 1:

$$f_{res} = \frac{1}{2\pi\sqrt{LC}} \tag{1}$$

Because of the opposite behaviors of inductors and capacitors, the theoretical impedance of a parallel inductor and capacitor (LC) resonant circuit goes to infinity at the resonant frequency $F_{res}$ resulting, theoretically, in a peak in the circuit response at that frequency similar to the peak 215 shown in FIG. 3B. In reality, losses in the inductor and the capacitor limit the sharpness of the response peak.

FIG. 4 is an output power-vs.-frequency graph 250 of a passband response curve of a hypothetical conventional bandpass filter. FIG. 4 is included here to show the expected signal response of conventional bandpass filters and to illustrate the elements of a filtered signal response including the type of response produced by the filter shown in FIG. 2. FIG. 4 shows a passband between the frequencies $f_1$ 255 and $f_2$ 260 and centered approximately around the resonant frequency fo 265. The cutoff frequencies, $f_1$ 255 and $f_2$ 260 are the frequencies at which the output signal power falls to half of the output signal power level at $f_0$ 265. The value of the difference between frequencies, that is, $(f_1-f_2)$, defines the filter bandwidth. The range of frequencies between frequencies $f_1$ 255 and $f_2$ 260 is the filter passband. FIG. 4 is included to show aspects of a desirable bandpass filter response curve. The leading and falling edges of the curve are called the skirts 270. Ideally, the skirts 270 of a bandpass filter response curve are steep, the bandwidth response 275 is flat and the knees 280 where the skirts meet the top of the curve are sharp. The graph of FIG. 4 is a typical response obtained when using prior art bandpass filters. The passband response for filtering close-in spurious frequencies needs improvements in all aspects of the response curve.

Figure 5A:
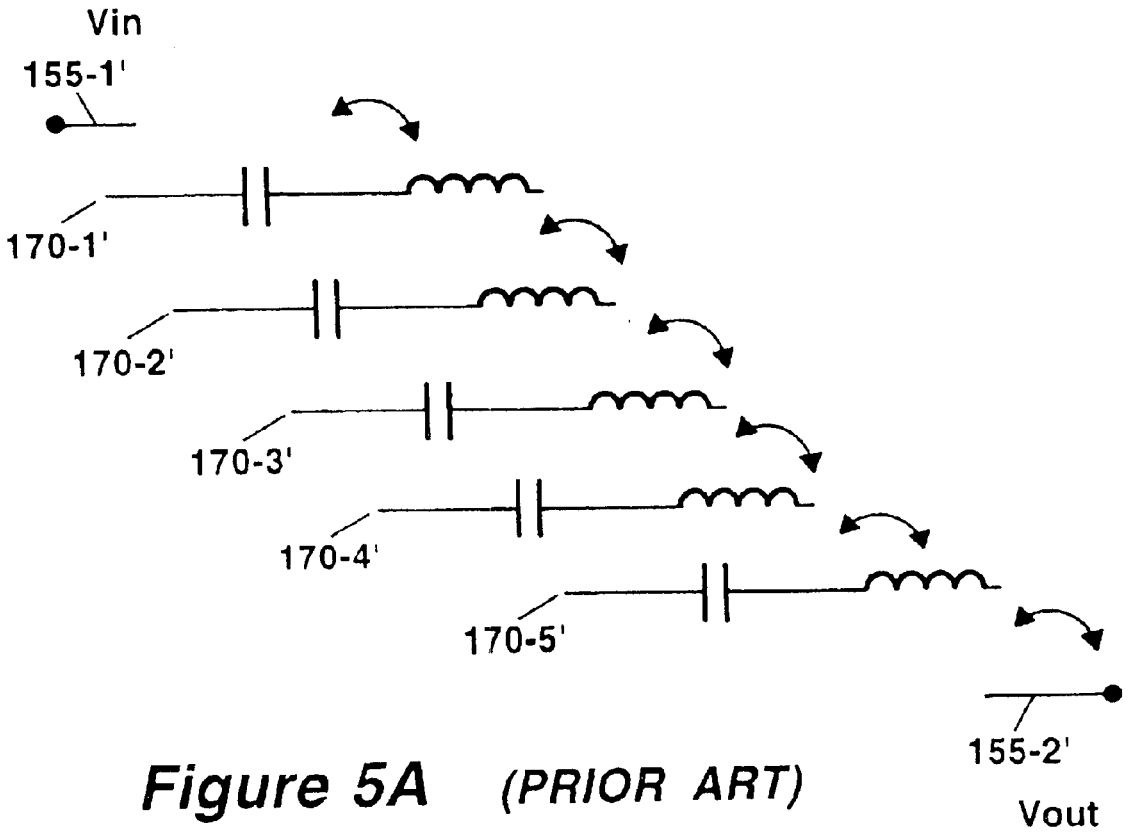
Figure 5A (PRIOR ART)
FIG. 5A is a part-representational, part circuit diagram of the prior art bandpass filter of FIG. 2.

FIG. 5A shows a part-representational, part-circuit diagram of the bandpass filter of FIG. 2 presented here to model the coupled stripline bandpass filter of FIG. 2. The feed lines 155 of FIG. 2 are represented by the Vin 155-1' and Vout 155-2' leads. Each resonator 170 of FIG. 2 is here represented by resonator diagrams 170'. Each circuit component is influenced by the adjacent components providing the response shown in FIG. 5B.

Figure 5B:
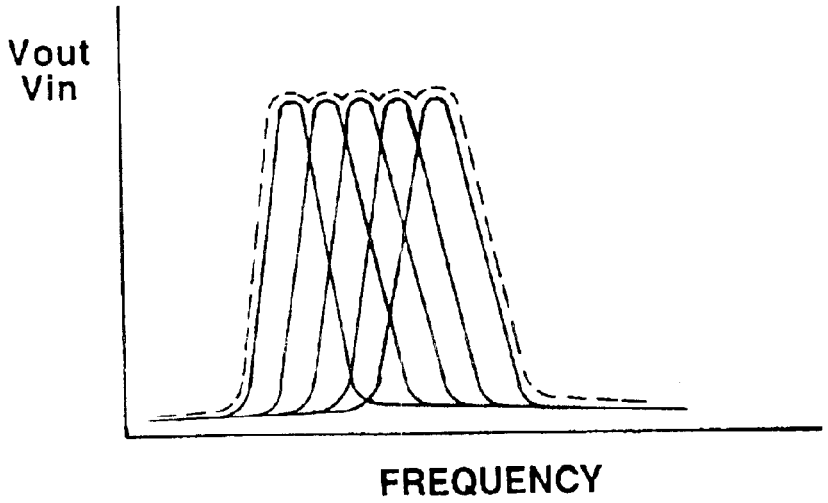
Figure 5B (PRIOR ART)
FIG. 5B is an amplitude vs. frequency graph of a typical passband response of the prior art bandpass filter of FIG. 5A.

FIG. 5B shows an amplitude-vs-frequency graph of the output signal of a bandpass filter circuit of the type shown in FIG. 5A. The response curve (shown as a dotted line) is the result of the combined responses of each of the individual resonators in the circuit (shown as solid lines). As described above, a prior art solution to increasing filter sharpness was to incorporate more resonators as in the bandpass filter shown in FIG. 2 and represented in FIG. 5A. It should be noted that the circuit response shown in FIG. 5B is similar to that shown in FIG. 4. As noted above, however, as the filter sharpness is increased by the additional resonators, the electrical performance of the filter is degraded.

FIG. 6 is a graph showing an example simulated passband response of the prior art filter of FIG. 2. The graph of FIG.

6 is an amplitude vs. frequency graph where amplitude is normalized in decibels. The curve $S_{21}$ 300 is the example simulated passband response of the prior art bandpass filter 150 of FIG. 2. As can be seen, the skirts 305-1, 305-2 of the curve 300 are not very steep, and therefore it can be seen that the ability to block close-in frequencies with the bandpass filter 150 of FIG. 2 would not be optimum. The minimum bandwidth of the topology of the bandpass filter of FIG. 2 is approximately 10% of the center frequency. Narrower passbands translate into wider gaps between the half-wave resonators making the passband "shape" of this topology very sensitive to surrounding circuits and the environment. In order to increase the close-in rejection of an edge-coupled filter such as that shown in FIG. 2, additional half-wave resonators can be added to the design to increase the steepness of the filter's skirts. The addition of additional poles, however, degrades the performance and manufacturability (i.e., repeatability) of the filter.

Figure 7:
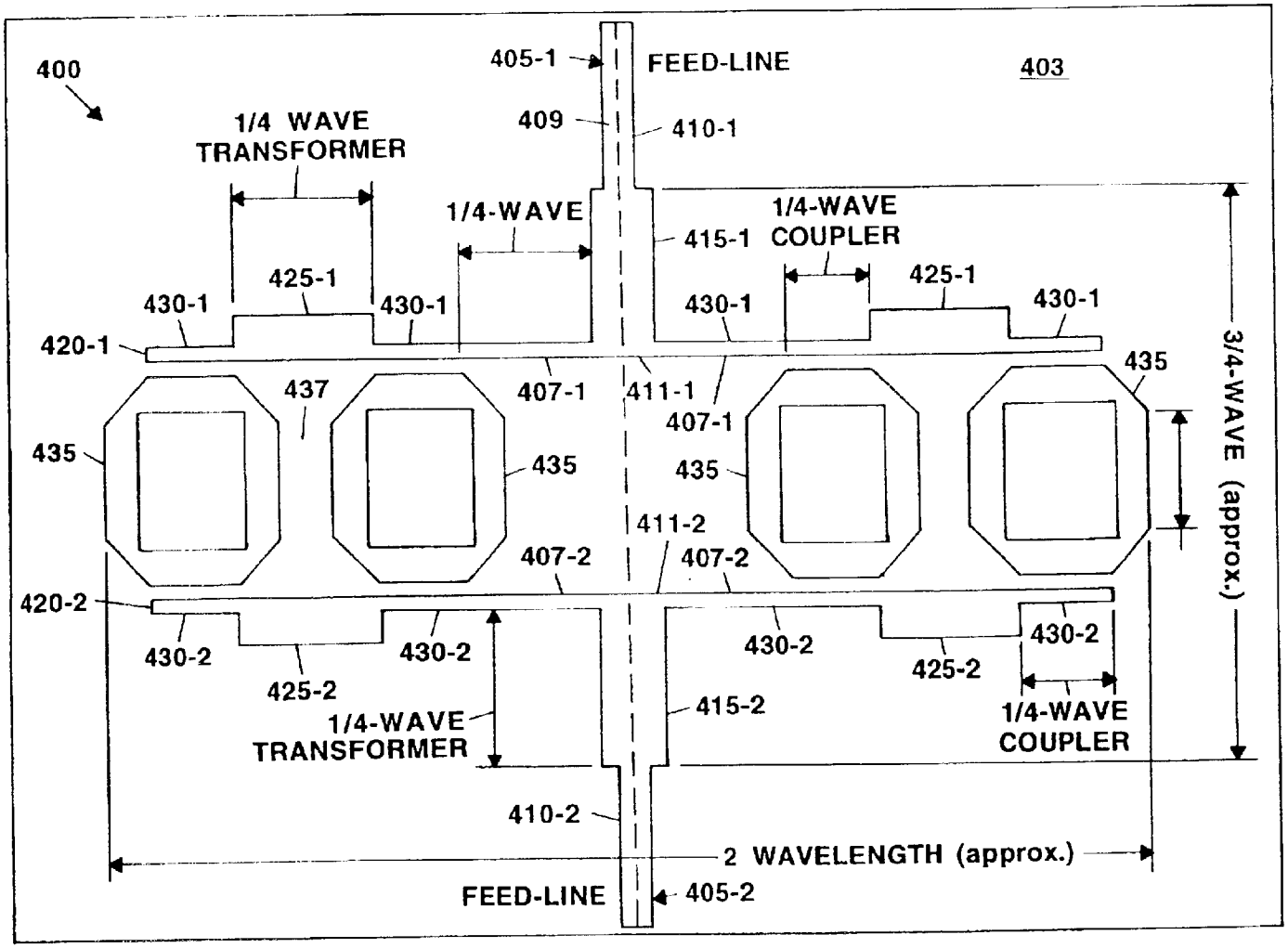
FIG. 7 is a top view of the elements on a substrate of a coupled-ring resonator filter according to principles of the invention.

FIG. 7 is a top view of the elements on a substrate 403 of a coupled-ring bandpass filter according to principles of the present invention. The coupled-ring bandpass filter is constructed from a plurality of rings placed orthogonally between the feed lines and coupled to the feed lines. Coupling herein means electromagnetically-coupled, not necessarily physically coupled. A typical range of operation for the filter is in the high-frequency range of the electromagnetic spectrum. The range includes the radio frequency range (RF) which is generally defined as those frequencies less than 3×109 Hz, the microwave range which is generally defined as those frequencies between 3×109 Hz–3×1010 Hz, and the millimeter-wave range which is generally defined as those frequencies between 3×1010 Hz–3×1011 Hz.

In one arrangement, the elements shown in FIG. 7 are realized as a microstrip circuit. In the microstrip, the elements are part of a signal plane layer on top of a core material and the core material has a ground plane at the back of the core material. The ground plane in a microstrip is typically a metallization layer. In a second arrangement, the elements shown in FIG. 7 are realized as a stripline where the elements are part of a signal layer embedded in, for example, a multilayer printed wiring board. On the outer sides of the core material, that is, the outsides of the structure are layers of metallization acting as ground planes. In a third arrangement, the elements shown in FIG. 7 are realized as a coplanar wave guide where the ground is located in the same plane as the elements. These arrangements may be manufactured using standard lithography techniques such as printed wiring board or thin film techniques.

The coupled-ring bandpass filter 400 of FIG. 7 has a first feed line 405-1 and a second feed line 405-2. In operation, one feed line is an input and other is an output, however, the circuit is symmetrical and so the input and output are, for the sake of simplicity, referred to by the same term. The feed lines 405-1, 405-2 are substantially centered on a mid-line that defines a bisecting line of the plane of the circuit 400. Each feed line 405 is split and has a stem 410 connected substantially perpendicularly to a cross-piece having two coupling extensions 420 that extend from either side of the stem 410. At the connecting point 407 to the cross 420, each stem 410 has a ¼-wave transformer 415. A transformer in the present application is an impedance transformer and is a ¼-wave element matching an impedance on one line with a different impedance on another line. The coupling extensions 420-1 of the first feed line 405-1 are substantially parallel to the coupling extensions 420-2 of the second feed line 405-2. The input coupling extensions form a first straight edge and the output coupling extensions form a second straight edge. Each coupling extension 407 has a ¼-wave transformer 425 and ¼-wave couplers 430 where there is a transformer 425 between each pair of couplers 430 on each coupling extension 420.

Between the first feed line 405-1 and the second feed line 405-2, and planar to the feed lines 405, are a plurality of ring-shaped resonators 435. The resonators 435 are positioned so that two of the resonators 435 are on one side of the mid-line 409 and two of the resonators 435 are positioned on the other side of the mid-line 409. The ring-shaped resonators 435 have flattened areas to provide better coupling to the feed lines 405 and to each other, so each ring-shaped resonator 435 is generally square-shaped, that is, each resonator 435 has a square-shaped profile. Each ring-shaped resonator 435 is substantially one quarter wave ($\lambda/4$) on each side. The selected frequency is a resonant frequency around which the passband of the filter 400 is substantially centered. The selected frequency is, essentially, the frequency to be passed by the bandpass filter 400. Each ring-shaped resonator 435 has a theoretical open and a theoretical ground. Further, each ring-shaped resonator 435 is coupled to a first coupler 430-1 on the first feed line 405-1 and also to a second coupler 430-2 on the second feed line 405-2. The ring-shaped resonators 435 are edge-coupled to each other as well as to the feed line ¼-wave couplers 430.

The ring resonators 435 resonate only at a particular band of frequencies. The ring resonators 435 interact in pairs. Each ring resonator 435 in a pair interacts with the adjacent resonator affecting the other resonator's resonant frequencies. Each ring resonator 435 is therefore slightly de-tuned providing a combined band of pass frequencies. If the gap 437 between the ring resonators 435 is large, the interaction between resonators 435 decreases. If the gap 437 between the ring resonators 435 is small, each resonator pulls strongly on the adjacent resonator. In this way, resonator placement is used to tune the bandpass filter. Other factors in tuning the filter include the overall length of the resonator and the placement of the resonator with respect to the feed lines. To a lesser degree than the other factors disclosed above, the width of the resonator line can be used to tune the filter.

While only two pairs ring resonators are shown here, alternative embodiments of the invention could include six ring resonators with three ring resonators on either side of the feed line stems forming triplets. Further alternative embodiments include eight ring resonators with four ring resonators on either side of the feed line stems forming four pairs of ring resonators, and so on. The scope of the invention is not limited to two pairs of ring resonators. Further alternate embodiments of the invention include resonators in which the ring is open. Specifically, the ring would have a gap in one side of the resonator, typically the side not coupled to an adjacent resonator or to a feed line. While the side of the ring resonator having the gap is "open," that side remains substantially ($\lambda/4$) long as do the other three sides of the resonator.

Figure 8:
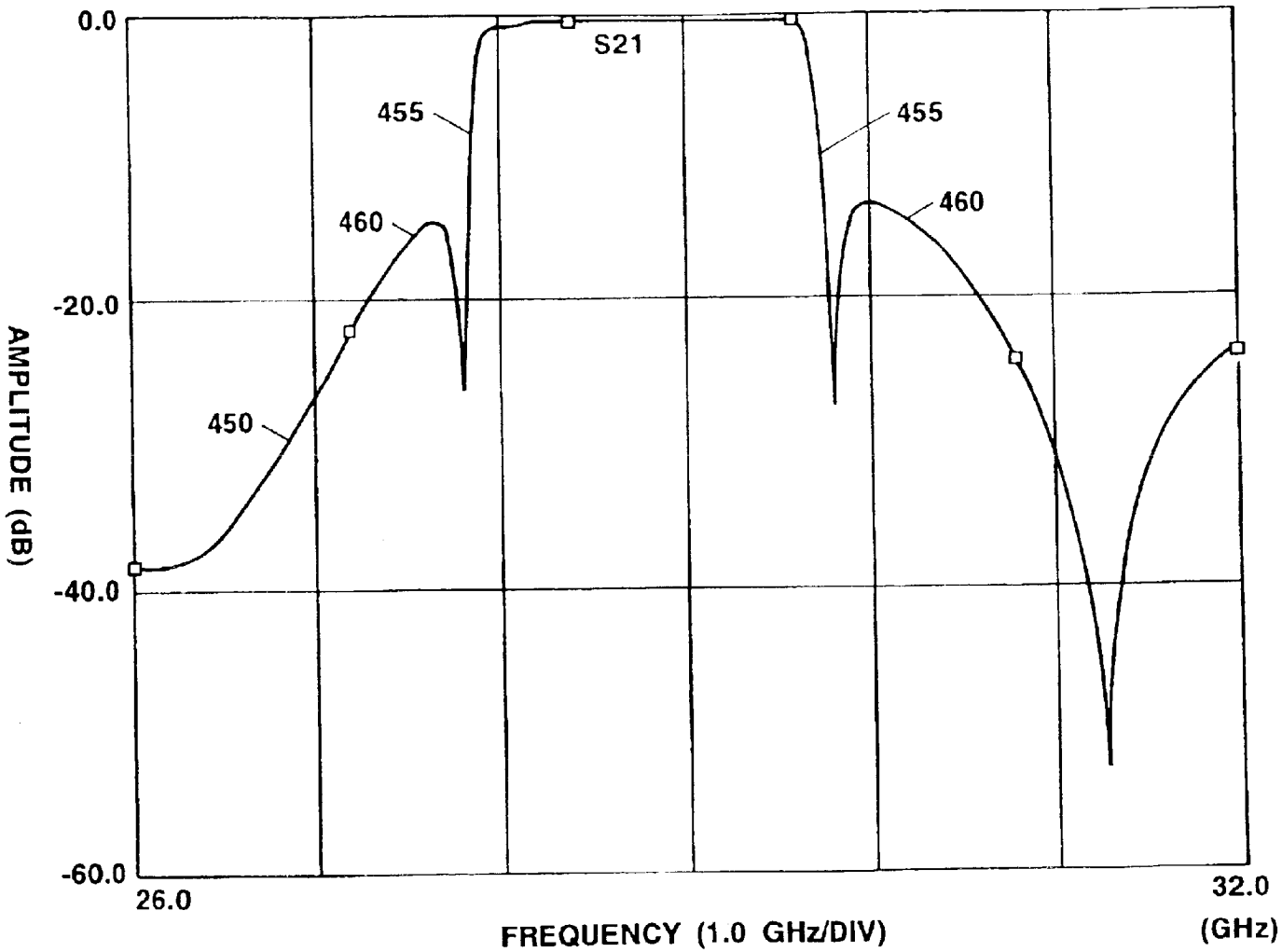
FIG. 8 is a graph showing an example simulated passband response of the coupled-ring resonator filter of FIG. 7.

FIG. 8 is a graph showing a simulated passband response of the coupled-ring resonator filter of FIG. 7 when operating according to principles of the present invention. The graph of FIG. 8 is an amplitude vs. frequency graph where amplitude is normalized in decibels. The $S_{21}$ curve 450 is the example simulated passband response of the bandpass filter 150 of FIG. 7. The passband response shown in FIG. 8 differs from the response of the prior art bandpass filters described above. As can be seen, the close-in skirts 455 of the curve 450 are steeper with respect to the prior art curve shown in FIG. 6. Therefore it can be seen that the ability to filter close-in frequencies with the bandpass filter 400 of FIG. 7 would be improved over the prior art bandpass filters. Where the skirts of the filter are steep, the passband is sharply defined. Here, the slopes of the lines through the cutoff frequencies (defined above in association with FIG. 4) are close to vertical. The side lobes 460 in the graph are part of the rejection band of the filter. The side lobes 460 are part of the ripple in the rejection band typical of Elliptic Response filters. As will be seen in cascaded filters, the passband can be further improved.

Figure 9:
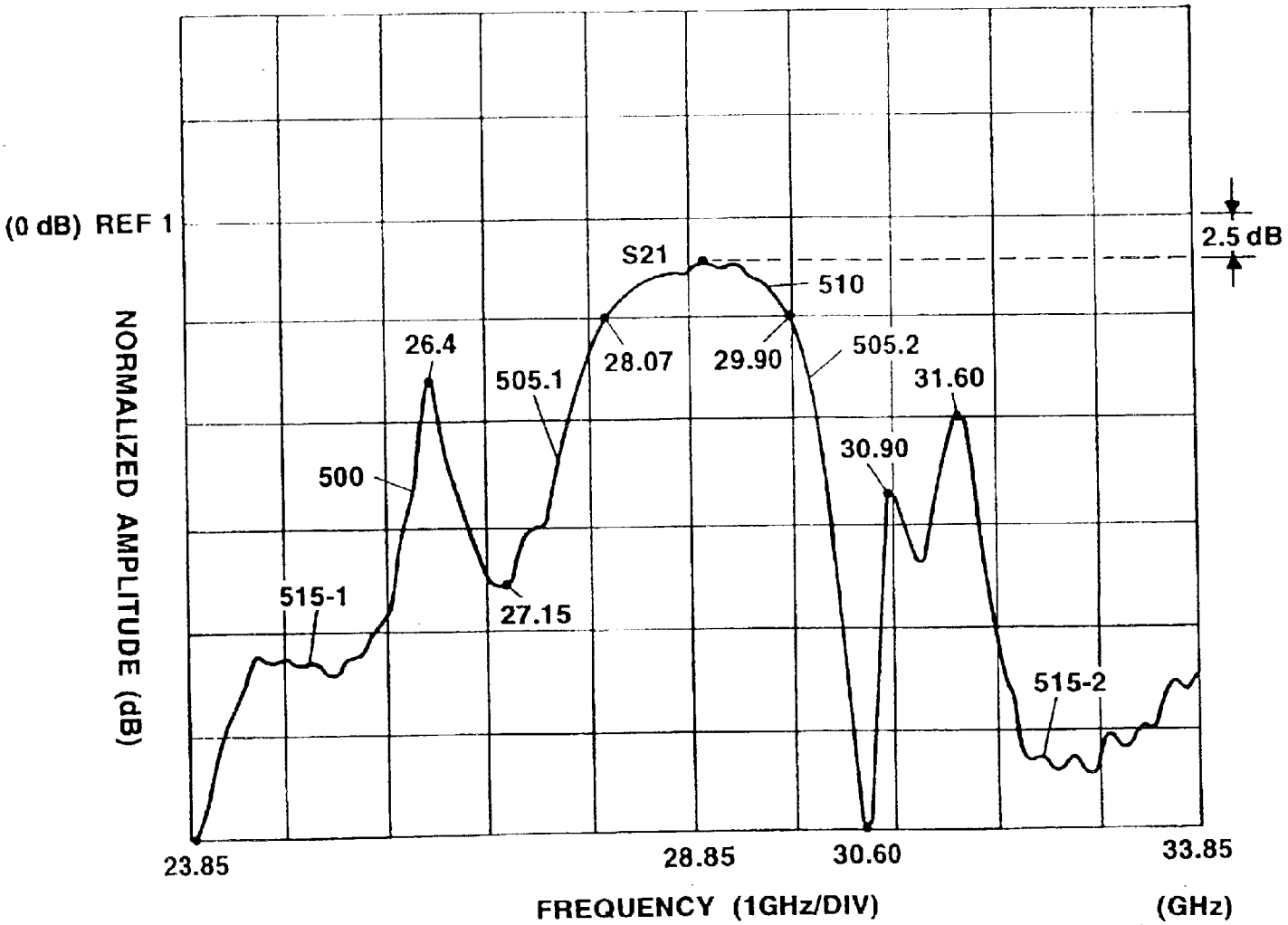
FIG. 9 is a graph of an example tested passband response of a coupled-ring resonator of the type shown in FIG. 7.

The simulated passband response shown in FIG. 8 was confirmed by testing the response of an actual fabricated circuit. FIG. 9 is a graph of an example tested passband response of a coupled-ring resonator of the type shown in FIG. 7. The graph of FIG. 9 is amplitude vs. frequency where amplitude is normalized in decibels. The frequency axis shown in the graph of FIG. 9 ranges from 23.85 GHz to 33.85 GHz. The curve $S_{21}$ 500 has its highest amplitude at 28.85 GHz, 2.5 dB below a reference amplitude of 0 dB. The skirts 505 of the curve, the first skirt 505-1 between 27.15 GHz and 28.07 GHz and the second skirt 505-2 between 29.90 GHz and 30.60 GHz are steep, as predicted by the simulated passband response shown in FIG. 8. The shape of the passband and skirts 500 has the characteristic Elliptic-Function response ripple in both the passband 510 and the stopband 515-2.

Figure 10:
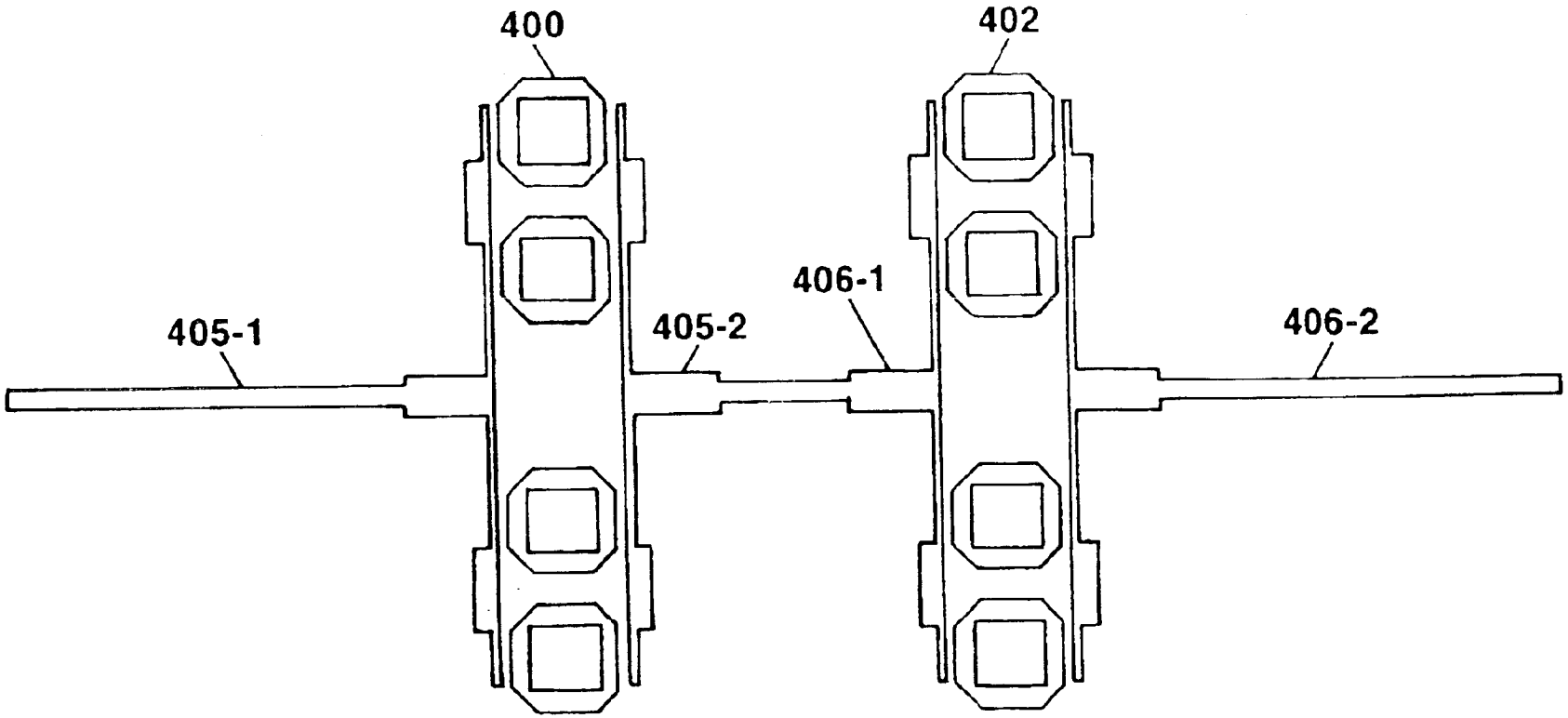
FIG. 10 is a top view of two coupled-ring resonators of FIG. 7 in a cascaded arrangement.

FIG. 10 is a top view of two coupled-ring resonators in a cascade arrangement. The coupled-ring resonator disclosed above can be cascaded in order to improve passband response. In FIG. 10, the coupled-ring resonator filter 400 of FIG. 7 having a input feed line 405-1 and an output feed-line 405-2 is connected in series to a second coupled-ring resonator filter 402 by connecting the output feed-line 405-2 of the first filter 400 to the input feed line 406-1 of the second filter 402. The resulting passband response is shown in FIG. 1. In alternative embodiments of the invention, three or more coupled-ring resonator filters can be cascaded to increase rejection outside the passband.

Figure 11:
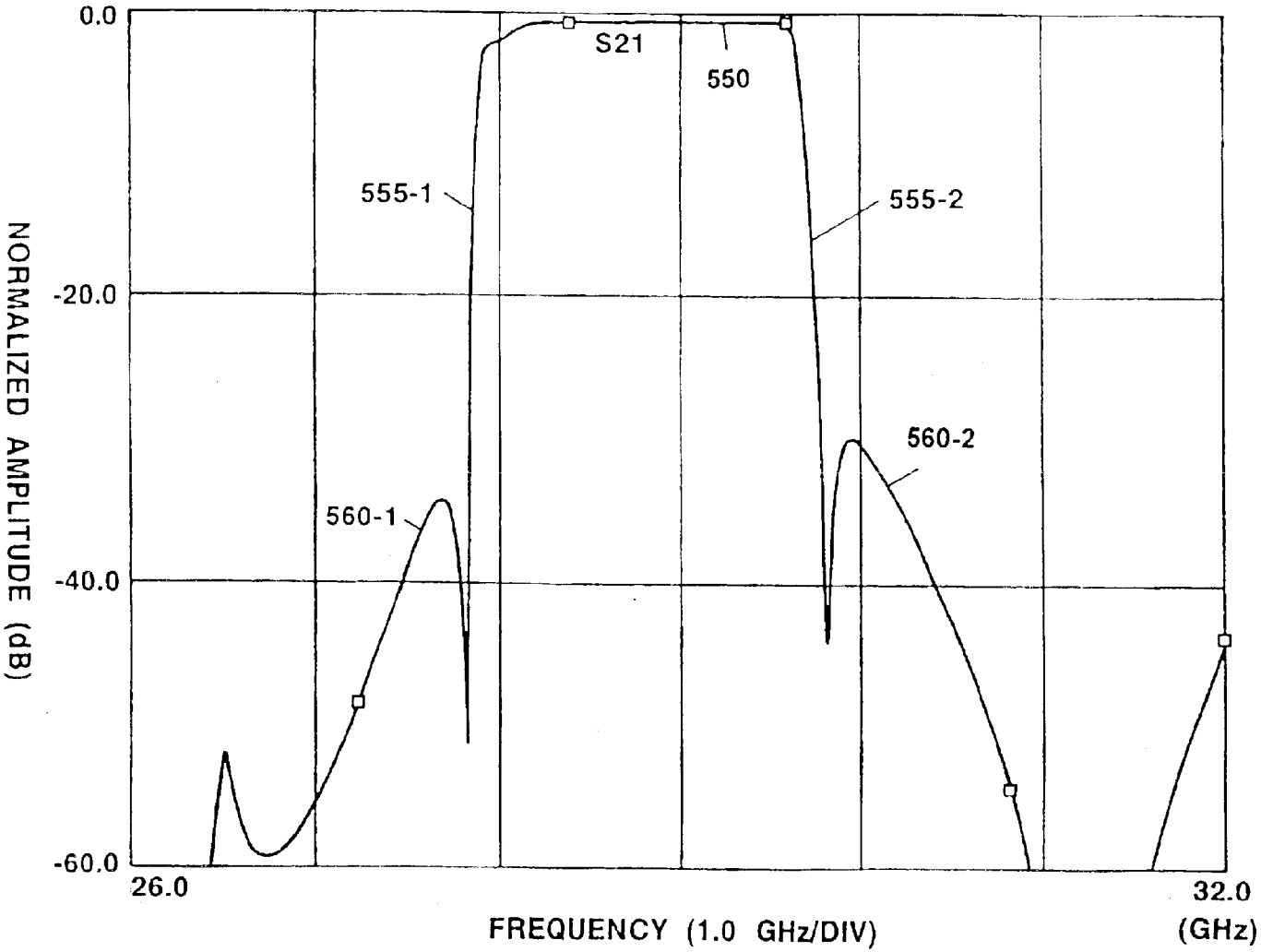
FIG. 11 is a graph showing an example simulated passband response for the cascaded coupled-ring resonator filters of FIG. 10.

FIG. 11 is a graph showing an example simulated passband response for the cascade coupled-ring resonator filters 400, 402 of FIG. 10 when operating according to principles of the present invention. The graph of FIG. 11 is amplitude vs. frequency graph where amplitude is normalized in decibels. The curve $S_{21}$ 550 is the example simulated passband response of the cascaded bandpass filters 400, 402 of FIG. 10. The passband response shown in FIG. 8 differs from the response of the prior art bandpass filters 150 described above. As can be seen, the skirts 555 of the curve 550 are steep, and there is improved rejection of the close-in spurious signals 560 from the single coupled-ring filter 400 shown in FIG. 7. Therefore, it can be seen that the ability to filter close-in frequencies with the bandpass filter 400 of FIG. 7 would be improved over the prior art bandpass filters 150.

Figure 12:
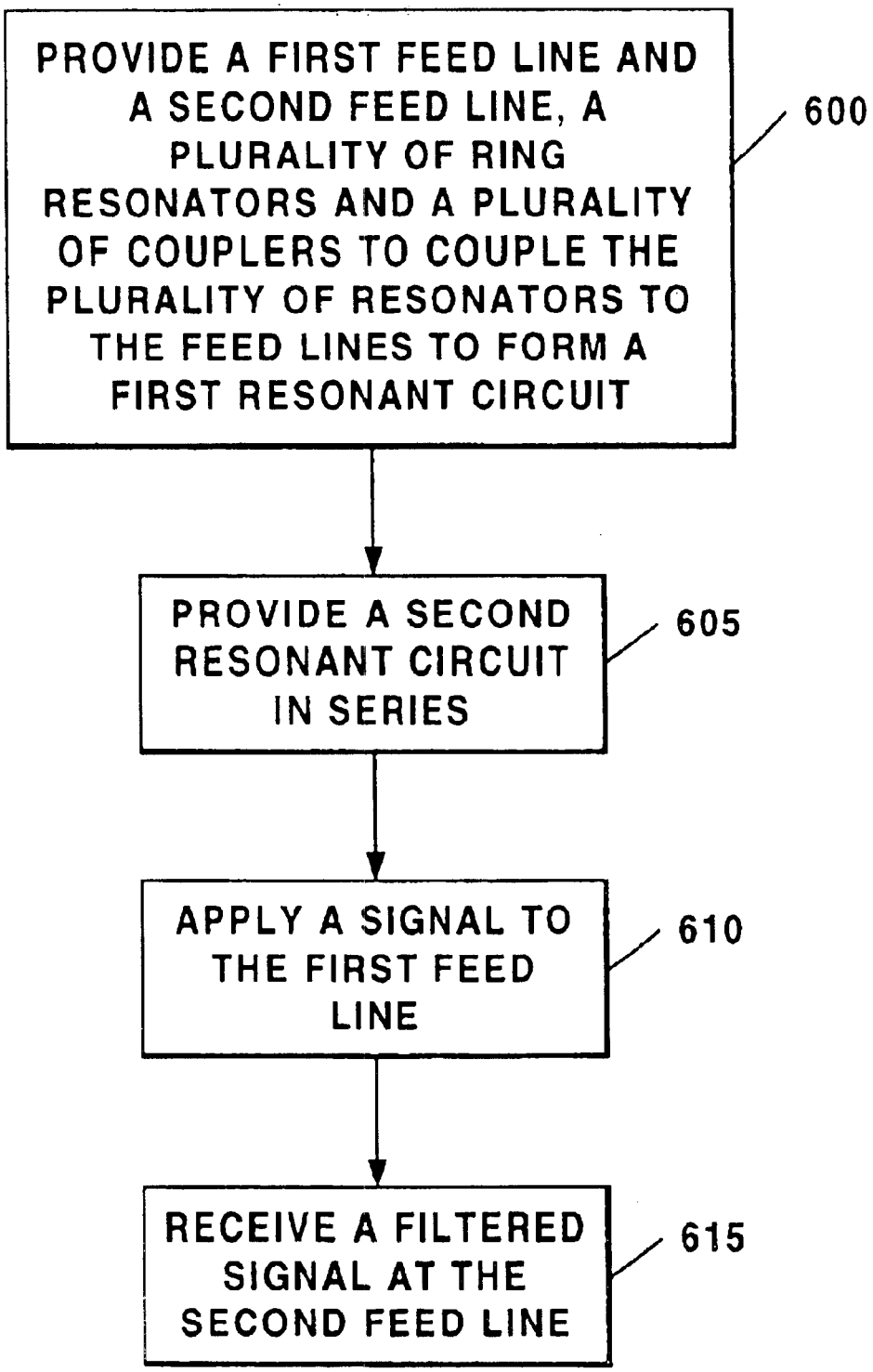
FIG. 12 is a flow chart of the assembly and operation of the filter of FIG. 7.

FIG. 12 is a flow chart of the assembly and operation of the filter 400 shown in FIG. 7. At step 600, a first feed line 405-1 and a second feed line 405-2 are provided for carrying signals. Further, a plurality of ring resonators 435 are provided to resonate in the filter circuit 400. A plurality of coupling extensions 420 are also provided. The coupling extensions 420 are physically attached to the feed lines 405 and signal-coupled to the resonators 435. Each feed line 405 has two coupling extensions 420. The ring resonators 435 are positioned between the coupling extensions 420 to form a resonant circuit 400 capable of filtering a signal.

At step 605, a second resonant circuit 402 is provided in series with the first resonant circuit 400 established in steps 600. The second resonant circuit 402 has a third and fourth feed lines where the third feed line is attached to the second feed line and receives the output signal of the first resonant circuit. The filtered output of both circuits in series is available at the fourth feed line.

At step 610, a signal is applied to the first feed line. The first resonant circuit and then the second resonant circuit filter the signal. At step 615, a filtered signal is received at the fourth feed line.

Figure 13:
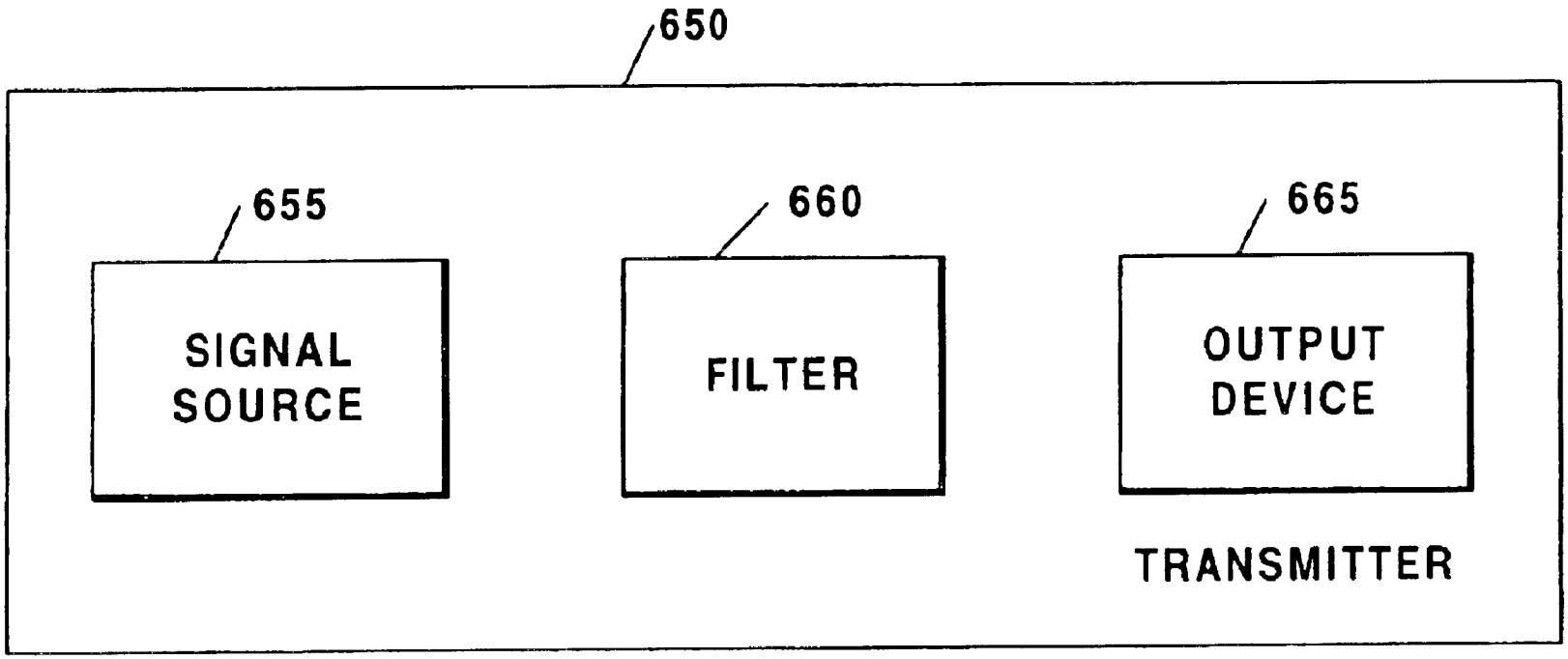
FIG. 13 is a transmitter including the filter of FIG. 7.
Figure 14:
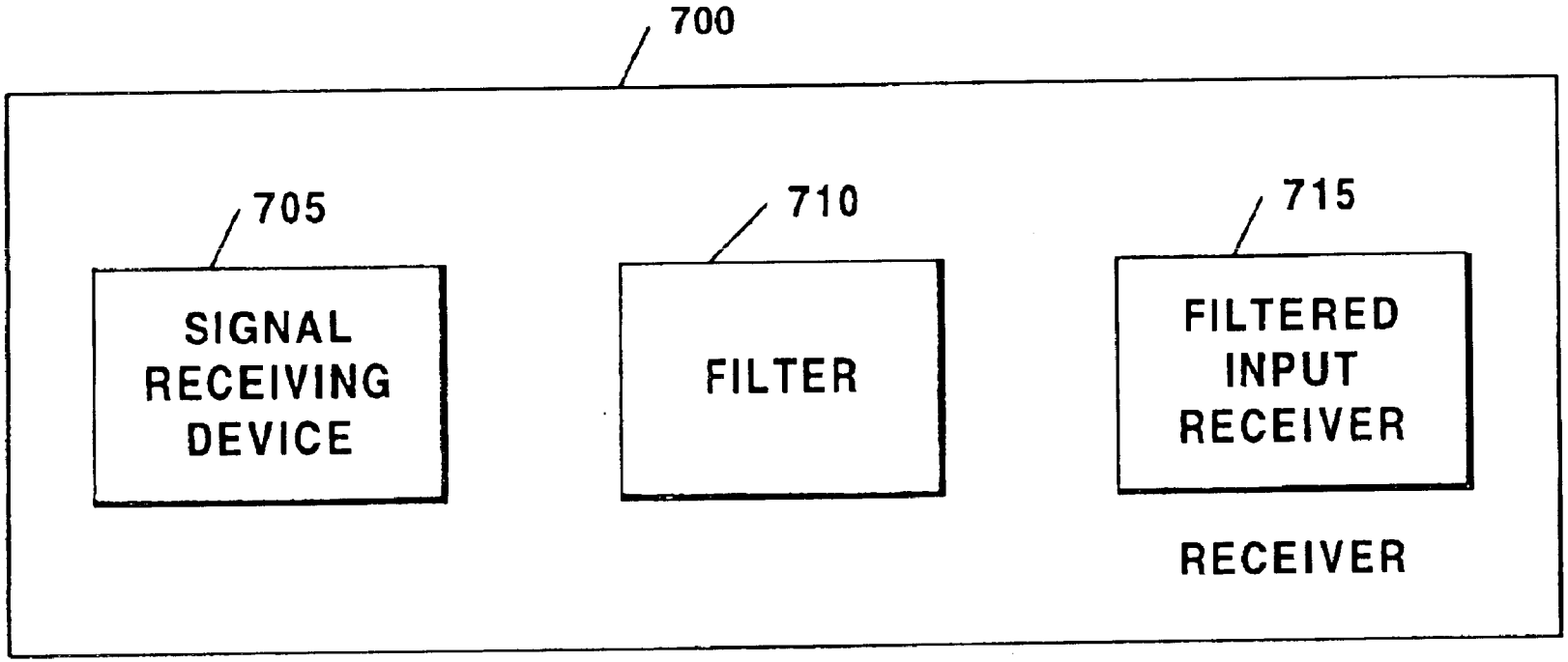
FIG. 14 is a receiver including the filter of FIG. 7.

FIG. 13 shows a transmitter system including a filter according to principles of the present invention and FIG. 14 shows a receiver system including a filter according to principles of the present invention. The transmitter and receiver systems could be used in any frequency-dependent application including, for example, radio, television, radar, cordless and cellular telephones, satellite communications systems, and some types of test, measurement and instrumentation systems.

FIG. 13 is a block diagram of a transmitter system 650 including a filter according to principles of the present invention. The transmitter 650 has a signal source 655 attached to a filter 660 attached to an output device 665. The filter 660 is configured and operates according to principles of the invention as disclosed above. The signal source 655 provides a signal to the filter 660. The filter 660 filters the signal and provides a filtered signal to the output device 665.

FIG. 14 is a block diagram of a receiver system 700 including a filter according to principles of the present invention. The receiver 700 has a signal receiving device 705 attached to a filter 710 attached to a filtered input receiver. The signal receiving device 705 receives a signal to be filtered. The signal receiving device 705 sends the signal to the filter 710. The filter 710 filters the signal and sends the filtered signal to the filtered input receiver 715.

In sum, the coupled-ring resonator filter 400 provides a sharp Elliptic-Function cutoff at a frequency close-in to both edges of the passband. The use of the inventive topology described above yields filters that are relatively small, narrow-band and provide high close-in rejection. The topology of the couple-ring resonator filter 400 permits the practical realization of a narrowband (less than 10% bandwidth) and a relatively high-Q filters. The inventive topology is also advantageous in that it can be realized using relatively inexpensive standard lithography processes such as thin film or printed substrate technologies.

While the coupled-ring resonator filters 400, 402 disclosed above are described for use in high-frequency environments, it is possible to use the inventive filter topology in other frequency ranges. The filters 400, 402 can effectively be re-sized to operate at lower frequencies. Different spacings between the resonators 435 and also between the resonators 435 and feed line couplers 420 can be made to achieve alternate bandpass characteristics.

In further alternative embodiments of the invention, the ring resonators could be rounded rings rather than square-shaped. The coupling extensions could, in this embodiment be straight or could follow the contours of the ring resonators. In another alternative embodiment, the feed line stem has a small split and each side of the split is connected to a coupling connection such that the coupling connections on a feed line are not physically connected to each other but rather to a side of the split which is then connected to the stem of the feed line.

It is to be understood that the above-described embodiments are simply illustrative of the principles of the invention. Various and other modifications and changes may be made by those skilled in the art which will embody the principles of the invention and fall within the spirit and scope thereof.

What is claimed is:

1. A filter, comprising:

a first feed line having a first stem connected to a first coupling extension and a second coupling extension;

a second feed line having second stem connected to a third coupling extension and a fourth coupling extension where said first coupling extension is substantially parallel to said third coupling extension and said second coupling extension is substantially parallel to said fourth coupling extension; and four ring resonators located planar to said first and said second feed lines, two of said ring resonators to form a first pair being positioned between said first and said third coupling extensions and two other of said ring resonators to form a second pair being positioned between said second and said fourth coupling extensions such that said four ring resonators are coupled to said feed lines to form a first resonant circuit.

2. The filter of claim 1 wherein each ring resonator is substantially a one quarter wavelength of a selected center frequency on each side, the passband of the bandpass filter being substantially centered on said selected center frequency.

3. The filter of claim 1 wherein at least one ring resonator is a square-shaped ring.

4. The filter of claim 3 wherein each side of said square-shaped ring is substantially ¼ wavelength of a selected center frequency, the passband of the bandpass filter being substantially centered on said selected center frequency.

5. The filter of claim 4 wherein a portion of each said coupling extension that is adjacent to a side of each square-shaped resonator forms a coupling point, each said coupling point being a substantially ¼ wave coupler.

6. The filter of claim 1 wherein said feed lines and said ring resonators are conductive features of a signal layer on a substrate.

7. The filter of claim 1 further comprising a fifth ring resonator between said first and said third coupling extensions and a sixth ring resonator between said second and said fourth coupling extensions.

8. The filter of claim 1 wherein said ring resonators are positioned relative to each other such that each said ring resonator affects resonance in adjacent resonators such that a passband of the bandpass filter is defined whereby the bandpass filter is tuned.

9. The filter of claim 1 configured to operate in the radio frequency region of the electromagnetic spectrum.

10. The filter of claim 1 configured to operate in the microwave region of the electromagnetic spectrum.

11. The filter of claim 1 configured to operate in the millimeter-wave region of the electromagnetic spectrum.

12. The filter of claim 1 further comprising a second resonant circuit in series with said first resonant circuit, said second resonant circuit having a third feed line having a third stem connected to a fifth coupling extension and a sixth coupling extension;

a fourth feed line having fourth stem connected to a seventh coupling extension and an eighth coupling extension where said fifth coupling extension is substantially parallel to said seventh coupling extension and said sixth coupling extension is substantially parallel to said eighth coupling extension; and a second set of four ring resonators located orthogonally and planar to said third and said fourth feed lines, two of said second set of ring resonators being positioned between said fifth and said seventh coupling extensions and two other of said second set of ring resonators being positioned between said sixth and said eighth coupling extensions such that said second set of four ring resonators are coupled to said third and fourth feed lines to form a second resonant circuit.

13. The filter of claim 1 wherein said filter is a bandpass filter.

14. The filter of claim 1 wherein at least one of the ring resonators comprises a closed ring resonator.

15. The filter of claim 1 wherein at least one of the first pair and the second pair of ring resonators orient substantially orthogonal to at least one of the first stem and the second stem.

16. The filter of claim 15 wherein the first stem defines a first stem long axis, the second stem defines a second stem long axis, the first pair of ring resonators defines a first ring resonator axis, and the second pair of ring resonators defines a second ring resonator axis wherein at least one of the first ring resonator axis and the a second ring resonator axis orient substantially orthogonal to at least one of the first stem long axis and the second stem long axis.

17. A method of forming a filter filtering, comprising the steps of:

providing a first feed line and a second feed line;

providing four ring resonators arranged as two pairs of two ring resonators positioned substantially orthogonal and planar to said feed lines; and providing a first pair of coupling extensions on said first feed line and a second pair of coupling extensions on said second feed line wherein said first pair of coupling extensions are substantially parallel to said second pair of coupling extensions and such that said feed lines couple to said four ring resonators to form a first resonant circuit.

18. The method of claim 17 wherein said step of providing four ring resonators further comprises providing ring resonators that are substantially square-shaped.

19. The method of claim 18 wherein said step of providing four ring resonators further comprises providing square-shaped ring resonators wherein each side of each said square-shaped ring is substantially ¼ wavelength of a selected center frequency, the passband of the bandpass filter being substantially centered on said selected center frequency.

20. The method of claim 17 further comprising the step of providing a second resonant circuit in series with said first resonant circuit such that said first and said second resonant circuit from a bandpass filter having a sharply defined passband.

21. The method of claim 17 further comprising the step of forming said first and second feed lines, said four ring resonators and said coupling extensions as features on a plane of a substrate using printed wiring board technology.

22. The method of claim 17 further comprising the step of forming said first and second feed lines, said four ring resonators and said coupling extensions as features on a plane of a substrate using thin film technology.

23. The method of claim 17 further comprising the step of configuring said first and said second feed lines, said four ring resonators and said coupling extensions to operate at radio frequencies.

24. The method of claim 17 further comprising the step of configuring said first and said second feed lines, said four ring resonators and said coupling extensions to operate at microwave frequencies.

25. The method of claim 17 further comprising the step of configuring said first and said second feed lines, said four ring resonators and said coupling extensions to operate at millimeter-wave frequencies.

26. The method of claim 17 comprising configuring at least one ring resonator as a closed ring resonator.

27. The method of claim 17 wherein:

the step of providing a first feed line and a second feed line comprises providing a first feed line defining a first feed line long axis and a second feed line defining a second feed line long axis; and the step of providing four ring resonators comprises providing four ring resonators arranged as two pairs of two ring resonators, a first pair of ring resonators defining a first ring resonator axis and a second pair of ring resonators defining a second ring resonator axis, the two pairs of ring resonators positioned planar to the feed lines and axis wherein at least one of the first ring resonator axis and the second ring resonator axis orient substantially orthogonal to at least one of the first feed line long axis and the second feed line long axis.

28. The method of claim 17 comprising:

configuring at least one ring resonator as a square-shaped ring resonator; and forming a coupling point between a portion of a coupling extension and an adjacent side of the square-shaped ring resonator, the coupling point being a substantially ¼ wave coupler.

29. A method for filtering a signal, the method comprising the steps of:

acquiring an input signal;

applying the input signal to an input of a filtering structure to generate an output signal on an output of the filtering structure, the filtering structure including a set of resonators oriented substantially orthogonal to the input and the output, wherein a mid-line of the input and the output define a bisecting line of a plane, wherein at least two resonators are disposed substantially within the plane on one side of the bisecting line, wherein at least two other resonators are disposed substantially within the plane on another side of the bisecting line, and wherein the set of resonators provides signal coupling between the input and the output causing the output signal to be based on the input signal; and conveying the output signal from the output.

30. A filter, comprising:

an input which is configured to receive an input signal;

an output which is configured to provide an output signal, a mid-line of the input and output defining a bisecting line of a plane; and a set of resonators disposed symmetrically between the input and the output and oriented substantially orthogonal to the input and the output, wherein at least two resonators are disposed substantially within the plane on one side of the bisecting line, wherein at least two other resonators are disposed substantially within the plane on another side of the bisecting line, and wherein the set of resonators provides signal coupling between the input and the output causing the output signal to be based on the input signal.

31. The filter of claim 30 wherein the input includes:

an input feed line having a first end which is configured to receive the input signal and a second end, and a set of input coupling extensions, each input coupling extension extending from the second end of the input feed line in a substantially perpendicular manner from the input feed line;

wherein the output of the filter includes:

an output feed line having a first end which is configured to provide the output signal and a second end, and a set of output coupling extension, each output coupling extension extending from the second end of the output feed line in a substantially perpendicular manner from the output feed line; and wherein the input coupling extensions are substantially parallel to the output coupling extensions and there is an even number of resonators disposed in a row between the set of input coupling extensions and the set of output coupling extensions.

32. The filter of claim 31 wherein the set of input coupling extensions defines a first straight edge, wherein the set of output coupling extensions defines a second straight edge, and wherein each resonator has a substantially square-shaped profile which is adjacent both the first straight edge and the second straight edge.

33. A transmitter, comprising:

a signal source circuitry which is configured to provide an input signal;

output circuitry which is configured to send an output signal; and a filter having an input coupled to the signal source circuitry, an output coupled to the output circuitry, and a set of resonators oriented substantially orthogonal to the input and the output, wherein a mid-line of the input and the output define a bisecting line of a plane, wherein at least two resonators are disposed substantially within the plane on one side of the bisecting line, wherein at least two other resonators are disposed substantially within the plane on another side of the bisecting line, and wherein the set of resonators provides signal coupling between the input and the output causing the output signal to be based on the input signal.

34. The transmitter of claim 33 wherein:

the input includes:

(i) an input feed line having a first end which is configured to receive the input signal and a second end, and (ii) a set of input coupling extensions defining a first straight edge, each input coupling extension extending from the second end of the input feed line in a substantially perpendicular manner from the input feed line;

the output includes:

(i) an output feed line having a first end which is configured to provide the output signal and a second end, and (ii) a set of output coupling extension defining a second straight edge, each output coupling extension extending from the second end of the output feed line in a substantially perpendicular manner from the output feed line;

the input coupling extensions orient substantially parallel to the output coupling extensions with an even number of resonators disposed in a row between the set of input coupling extensions and the set of output coupling extensions; and each resonator has a substantially square-shaped profile which is adjacent both the first straight edge and the second straight edge.

35. A receiver, comprising:

input circuitry which is configured to receive an input signal;

rendering circuitry which is configured to render an output signal; and a filter having an input coupled to the input circuitry, an output coupled to the rendering circuitry, and a set of resonators oriented substantially orthogonal to the input and the output, wherein mid-line of the input and the output define a bisecting line of a plane, wherein at least two resonators are disposed substantially within the plane on one side of the bisecting line, wherein at least two other resonators are disposed substantially within the plane on another side of the bisecting line, and wherein the set of resonators provides signal coupling between the input and the output causing the output signal to be based on the input signal.

36. The receiver of claim 35 wherein:

the input includes:

(i) an input feed line having a first end which is configured to receive the input signal and a second end, and (ii) a set of input coupling extensions defining a first straight edge, each input coupling extension extending from the second end of the input feed line in a substantially perpendicular manner from the input feed line;

the output includes:

(i) an output feed line having a first end which is configured to provide the output signal and a second end, and (ii) a set of output coupling extension defining a second straight edge, each output coupling extension extending from the second end of the output feed line in a substantially perpendicular manner from the output feed line;

the input coupling extensions orient substantially parallel to the output coupling extensions with an even number of resonators disposed in a row between the set of input coupling extensions and the set of output coupling extensions; and each resonator has a substantially square-shaped profile which is adjacent both the first straight edge and the second straight edge.

* * * * *